US011426997B2

(12) United States Patent
Slaats et al.

(10) Patent No.: US 11,426,997 B2
(45) Date of Patent: Aug. 30, 2022

(54) METHOD OF INK JET PRINTING USING A PRIMER

(71) Applicant: Canon Production Printing Holding B.V., Venlo (NL)

(72) Inventors: Bianca P. S. Slaats, Venlo (NL); Jantina C. De Vries, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 56 days.

(21) Appl. No.: 17/192,285

(22) Filed: Mar. 4, 2021

(65) Prior Publication Data

US 2021/0187990 A1 Jun. 24, 2021

Related U.S. Application Data

(63) Continuation of application No. PCT/EP2019/073614, filed on Sep. 4, 2019.

(30) Foreign Application Priority Data

Sep. 5, 2018 (EP) ..... 18192718

(51) Int. Cl.
*B41J 2/14* (2006.01)
*B41J 11/00* (2006.01)
*B41M 5/00* (2006.01)

(52) U.S. Cl.
CPC ..... *B41J 2/14* (2013.01); *B41J 11/0015* (2013.01); *B41M 5/0017* (2013.01)

(58) Field of Classification Search
CPC ..... B41J 2/14; B41J 11/0015; B41M 5/0017
See application file for complete search history.

(56) References Cited

U.S. PATENT DOCUMENTS

2006/0238592 A1 10/2006 Kadomatsu et al.
2007/0013759 A1 1/2007 Kadomatsu et al.
2010/0225720 A1 9/2010 Ishida
(Continued)

FOREIGN PATENT DOCUMENTS

EP 2 266 803 A1 12/2010
JP 2008-238747 A 10/2008
(Continued)

OTHER PUBLICATIONS

International Search Report (PCT/ISA/210) issued in PCT/EP2019/073614 dated Oct. 18, 2019.
(Continued)

*Primary Examiner* — Justin Seo
(74) *Attorney, Agent, or Firm* — Birch, Stewart, Kolasch & Birch, LLP

(57) ABSTRACT

A method of ink jet printing comprising a step of printing a primer onto a media sheet is disclosed. This method comprises a step of printing with ink onto the media sheet so as to form an image superposed on the primer, the step of printing with ink being carried out with a print head having an array of nozzles staggered in several rows, while performing a relative scan movement of the print head and the media sheet in a transport direction normal to the rows. The primer is printed on the media sheet non-uniformly in a pattern that corresponds with a pattern in which the nozzles of the print head are staggered.

6 Claims, 4 Drawing Sheets

(56) References Cited

U.S. PATENT DOCUMENTS

| | | | |
|---|---|---|---|
| 2012/0313990 | A1 | 12/2012 | Sakai |
| 2015/0367655 | A1 | 12/2015 | Hara |
| 2018/0065381 | A1 | 3/2018 | Takasugi et al. |

FOREIGN PATENT DOCUMENTS

| | | | | |
|---|---|---|---|---|
| JP | 2012-76440 | A | 4/2012 | |
| WO | WO-0111426 | A1 * | 2/2001 | ..... B05D 1/02 |

OTHER PUBLICATIONS

Written Opinion (PCT/ISA/237) issued in PCT/EP2019/073614 dated Oct. 18, 2019.

* cited by examiner

METHOD OF INK JET PRINTING USING A PRIMER

CROSS-REFERENCE TO RELATED APPLICATIONS

This application is a Continuation of PCT International Application No. PCT/EP2019/073614, filed on Sep. 4, 2019, which claims priority under 35 U.S.C. § 119 to Application No. 18192718.7, filed in Europe on Sep. 5, 2018. The entirety of each of the above-identified applications is expressly incorporated herein by reference.

BACKGROUND OF THE INVENTION

1. Field of the Invention

The invention relates to a method of ink jet printing comprising a step of printing a primer onto a media sheet and a step of printing with ink onto the media sheet so as to form an image superposed on the primer, the step of printing with ink being carried out with a print head having an array of nozzles staggered in several rows, while performing a relative scan movement of the print head and the media sheet in a transport direction normal to the rows. More particularly, the invention relates to a method of single-pass printing with water-based ink.

2. Background of the Invention

It is well known that, in single-pass printing, the printed image tends to become streaky because the ink dots formed with the different nozzles of the print head do not fully merge with one another and do not form a uniform ink layer. In particular, the staggered arrangement of the nozzles, which is necessary for obtaining a high print resolution in the direction of the rows (normal to the transport direction), has the consequence that neighboring pixels in the same pixel line of the printed image are printed at different timings. Depending upon the nozzle configuration and on the content of the printed image, this may lead to a situation where an ink drop (or a line formed by several ink dots) that has just hit the media sheet has considerable time to spread equally in all directions before a neighboring ink dot is printed. A neighboring dot may touch the earlier dot and extend preferably in the direction of that earlier dot by coalescence of the two dots. In that case, whereas the first-printed dot has no chance to come into contact with and merge with a neighboring dot, the position of the later printed dot is affected by the presence of the earlier printed one. This results in a possible occurrence of undesired voids or gaps between dots, or lines of dots, in the printed image. This effect may be aggravated further if the positional accuracy of the dot forming process is poor, so that the ink dots may deviate from their target positions.

It has been known to use a primer for "pinning" the ink dots on the media sheet by reducing the mobility of the liquid ink as long as it is not yet cured. This can reduce the tendency of the ink to spread and coalesce.

Conventionally, the primer is applied in the form of an essentially uniform layer. However, the primer layer itself may contribute to the streakiness of the printed image because it reduces the ability of the ink droplets to merge with one another.

A known measure to reduce the streakiness of the image is to increase the size of the ink drops. This, however, has major drawbacks in terms of graininess of the image and robustness of the ink layer. For example, increasing the drop size increases the tendency of the cured ink to peel-off from the surface of the media sheet.

It is an object of the invention to provide a printing method of the type indicated above which can achieve an improved image quality.

SUMMARY OF THE INVENTION

In order to achieve this object, the method according to the invention comprises the step of printing the primer non-uniformly on the media sheet in a pattern that corresponds with a pattern in which the nozzles of the print head are staggered.

It has been found that such a non-uniform distribution of the primer on the surface of the media sheet locally reduces the coalescence of dots and at the same time avoids the occurrence of image defects such as gaps between adjacent ink dots.

More specific optional features of the invention are indicated in the dependent claims.

In one embodiment, the primer may be concentrated in those pixel rows where there is a particularly large offset between neighboring print head nozzles. In this case, the pinning effect of the primer reduces the coalescence of the ink dots to such an extent that dots that are initially isolated on the surface of the media sheet will not spread too much in the time until the neighboring dots are printed as well. On the other hand, in those areas of the image where the delay between the printing times of neighboring dots is small, the amount of primer can be reduced, so that a desired mobility of the liquid ink is maintained and the overall streakiness of the image is reduced.

The pattern of the non-uniform distribution of the primer on the surface of the media sheet may be blurred further by employing filter algorithms such as dithering or error diffusion. This helps to avoid artefacts that might result from the fact that the presence of primer may induce differences in gloss or color of the printed image.

BRIEF DESCRIPTION OF THE DRAWINGS

An embodiment example will now be described in conjunction with the drawings, wherein.

DETAILED DESCRIPTION OF EMBODIMENTS

Figure 1:
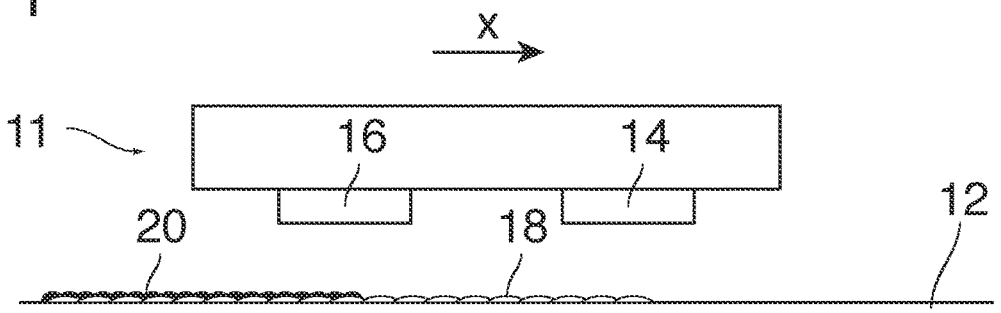
FIG. 1 is a schematic view of a print head assembly scanning a surface of a media sheet for printing a primer layer and an ink layer.

As is shown in FIG. 1, an ink jet printer has a print head assembly 11 arranged to scan the surface of a media sheet 12 in a transport direction x. The print head assembly 11 comprises a primer print head 14 and an ink print head 16 arranged in parallel and extending over the entire width of the media sheet 12 in a line direction y (FIG. 2) normal to the transport direction x. In this case the print head assembly 11, which extends perpendicularly to the plane of the drawing in FIG. 1, is transported over the media sheet 12, but the reverse, the media sheet being transported underneath a fixed print head assembly, is equally well possible. Thus, an image can be printed on the media sheet 12 in a single scan pass of the print head assembly 11 relative to the media sheet.

As the print head assembly 11 moves in the transport direction x, a layer of primer 18 will be printed first, and a layer of ink 20 will be printed so as to superpose the primer layer. The spacing between the print heads 14 and 16 may be selected such that the primer printed with the primer print head 14 has dried sufficiently at the time when the ink layer 20 is printed with the ink print head 16.

Figure 2:
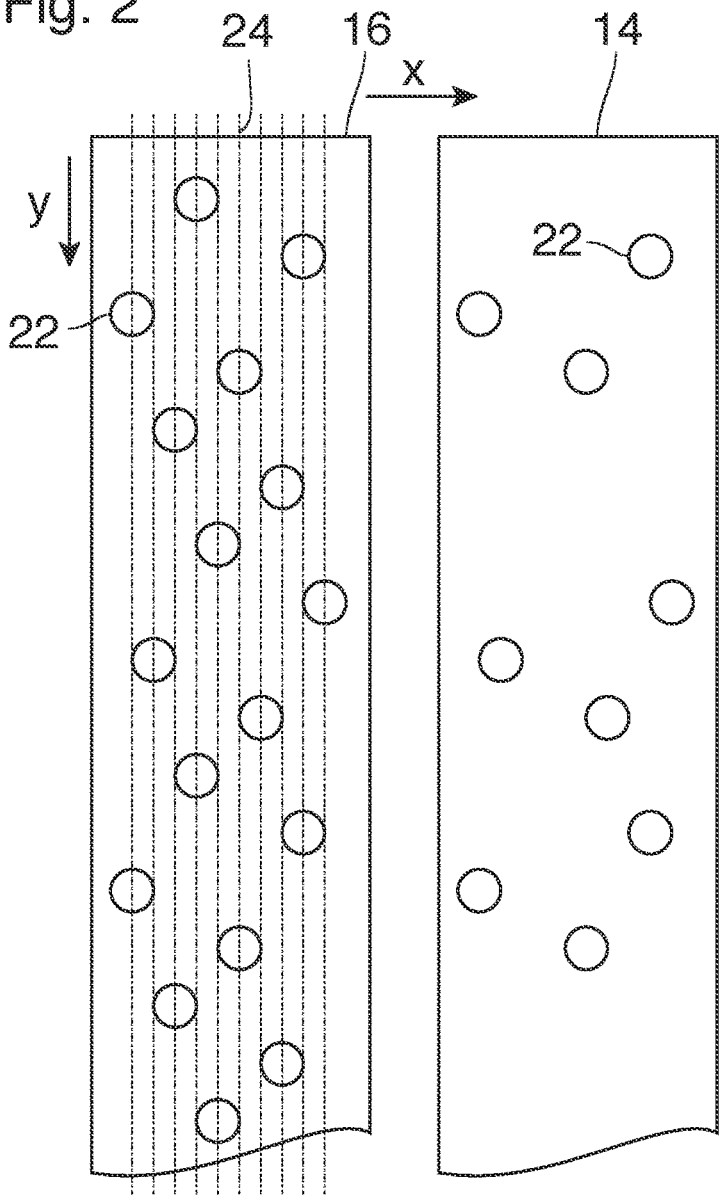
FIG. 2 is a view of nozzle plates of the print heads in the print head assembly shown in FIG. 1.

FIG. 2 shows top plan views of nozzle plates of the ink print head 16 and the primer print head 14. The ink print head 16 has nozzles 22 arranged in a number n (=10 in this example) of rows 24 that extend in the line direction y. The nozzles 22 are staggered such that, in a group of n nozzles that are consecutive in the line direction y, each nozzle is placed on a different one of the rows 24. Then, for the next group of n nozzles, the staggering pattern is repeated. The staggering pattern permits to make the difference in y-position between two adjacent nozzles so small (optionally even smaller than the diameter of the nozzle) that a high print resolution in the line direction y can be achieved. However, in order to print a straight line of ink dots extending in the line direction y, the nozzles 22 have to be fired at different timings, dependent upon their offset in the scanning direction x.

The primer print head 14 may have the same pattern of nozzles 22, but for reasons that will be explained later, nozzles in some of the y-positions are missing.

Figure 3:
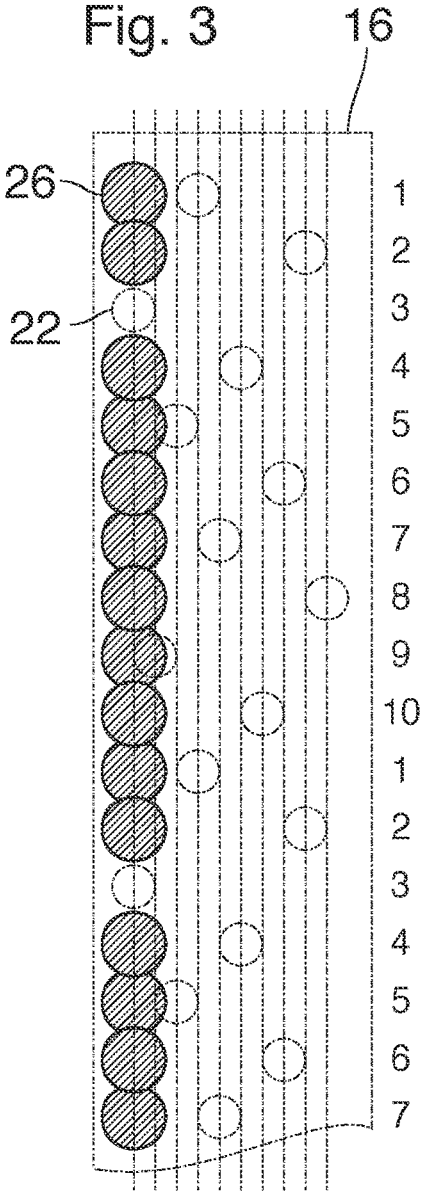
FIG. 3 shows a printing step in which a line of ink dots is being completed.

FIG. 3 illustrates a situation in which a pixel line, i.e. a line of ink dots 26 that extends in the line direction y, is just being completed. The position of the ink print head 16 and its nozzles at that instant in time has been shown in phantom lines. The y-positions of the nozzles in each group of n nozzles have been designated as 1-10. The line of ink dots 26 has a gap in pixel position 3, and the nozzles 22 in the last row are just moving over that gap in order to close the gap by filling-in another ink dot. It will be understood that the ink dots 26 that are present already in FIG. 3 have been printed earlier, at a time when their corresponding nozzle had reached the pixel line in the course of the scan-movement of the print head.

As can be seen in FIG. 3, the size of the ink dots 26 is so large that the contours of neighboring ink dots overlap, so that a continuous black line of ink is formed. For simplicity, it is assumed that the ink jet printer in this example is a black and white printer. The generalization of the invention to color printers is straightforward.

As long as the liquid ink in the ink dots 26 is not yet cured or dried, cohesion forces will cause a tendency of the ink to coalesce, so that the ink dots will merge with each other. Typically, this coalescence leads to a contraction in length of the ink line segments that are separated by the gaps in FIG. 3, so that the gaps tend to become larger.

When a solid black image area is to be formed by printing a plurality of consecutive ink lines, the coalescence may also lead to a merger of the adjacent ink lines, so that an essentially uniform ink layer is formed in a two-dimensional area.

The purpose of the primer layer 18 is to limit the coalescence of the ink, in particular in order to prevent the gaps in the ink lines from becoming so large that they can no longer be filled-up by a single ink dot.

Figure 4:
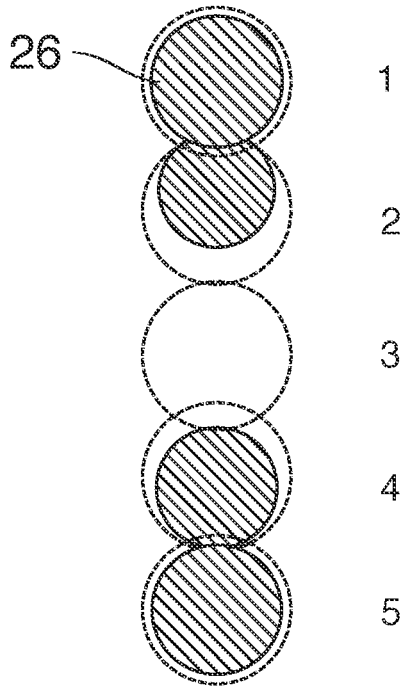
FIG. 4 is an enlarged detail of the ink dot pattern shown in FIG. 3, for the case that no primer has been used.

For comparison, FIG. 4 shows a detail of a line of ink dots 26 (extending over y-positions 1-5) that would be obtained if no primer layer 18 were formed on the media sheet. In that case, coalescence would lead to a displacement of already printed dots in the line direction. The original contours and positions of the ink dots have been shown in dashed lines in FIG. 4, and the areas of the ink dots at the time when the gap in position 3 is filled has been indicated by hatching. It can be seen that the dot in position 2 is displaced considerably because, as can be inferred from FIG. 3, this dot was printed very early, in the second one of the lines 24, so that coalescence could occur over a comparatively long period of time. In contrast, displacement of the (younger, later applied) dots in positions 1 and 5 is significantly smaller, whereas the displacement for the dot in position 4 (printed by a nozzle in the fifth row 24; see FIG. 3) is also relatively large but not quite as large as for the dot in position 2. Thus, the dots in positions 2 and 4 have been shifted away from position 3 at the time when they merged with the dot in position 1 and 5, respectively. As a consequence, the gap at position 3 has increased significantly, and when an ink dot is printed in that position (indicated by a circle in dashed lines), the dot might still contact and merge with the dot in position 4, but the dot in position 2 would be too far away, so that the gap in the ink line cannot be filled completely. This would lead to a disturbing artefact in the printed image.

Figure 5:
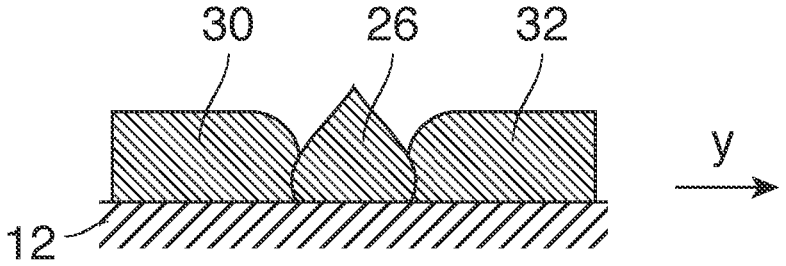
FIGS. 5 to 7 are sectional views of pixel lines of a printed image, illustrating possible causes for artefacts.
Figure 6:
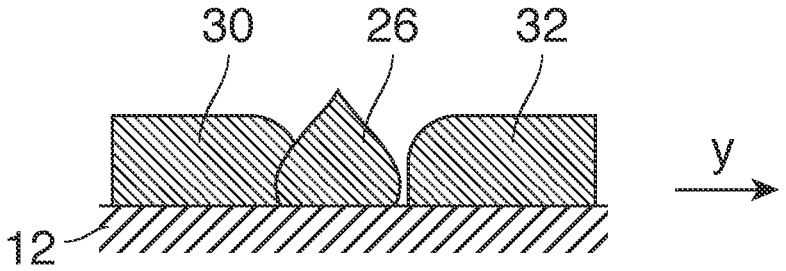
Figure 7:
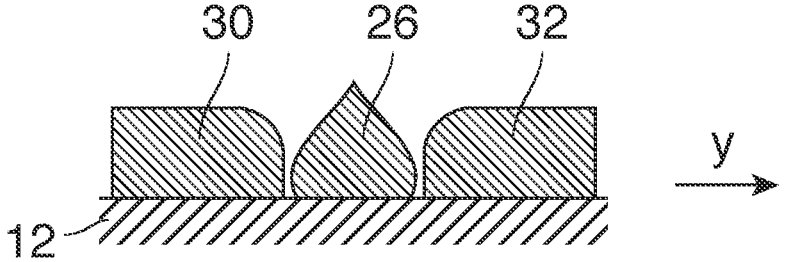

In order to illustrate this effect further, FIGS. 5 to 7 show longitudinal sections of pixel lines in different scenarios, in which a gap between two continuous ink line segments 30, 32 is to be filled by another ink dot 26. In FIG. 5, the gap is small enough to be filled by the ink dot 26, so that the ink of that dot will merge with the continuous line segments 30 and 32. FIG. 6 illustrates a situation where the gap would be small enough, but the ink dot 26 has been jetted out by the corresponding nozzle with a directional error so that it does not exactly hit the gap. Consequently, the dot will only merge with the line segment 30 on the left side in FIG. 6 but will remain separated from the line segment 32 on the right side. FIG. 7 illustrates a situation similar to FIG. 4, where the gap between the segments 30 and 32 is too large to be filled by the dot 26, so that smaller gaps remain on both sides of the dot 26.

In principle, the artefacts produced in the scenarios shown in FIGS. 6 and 7 can be avoided by using the primer 18 for pinning the ink on the surface of the media sheet 12. However, the primer layer 18 reduces the spreading of the liquid ink in all directions and may therefore in another way contribute to the streakiness of the printed image.

In order to resolve this conflict, the primer is applied on the media sheet 12 not in the form of a uniform layer but with a non-uniform distribution in accordance with a pattern that corresponds to the pattern of the staggering of the nozzles 22 in the ink print head 16, as will now be explained in conjunction with FIGS. 8 to 11.

Figure 8:
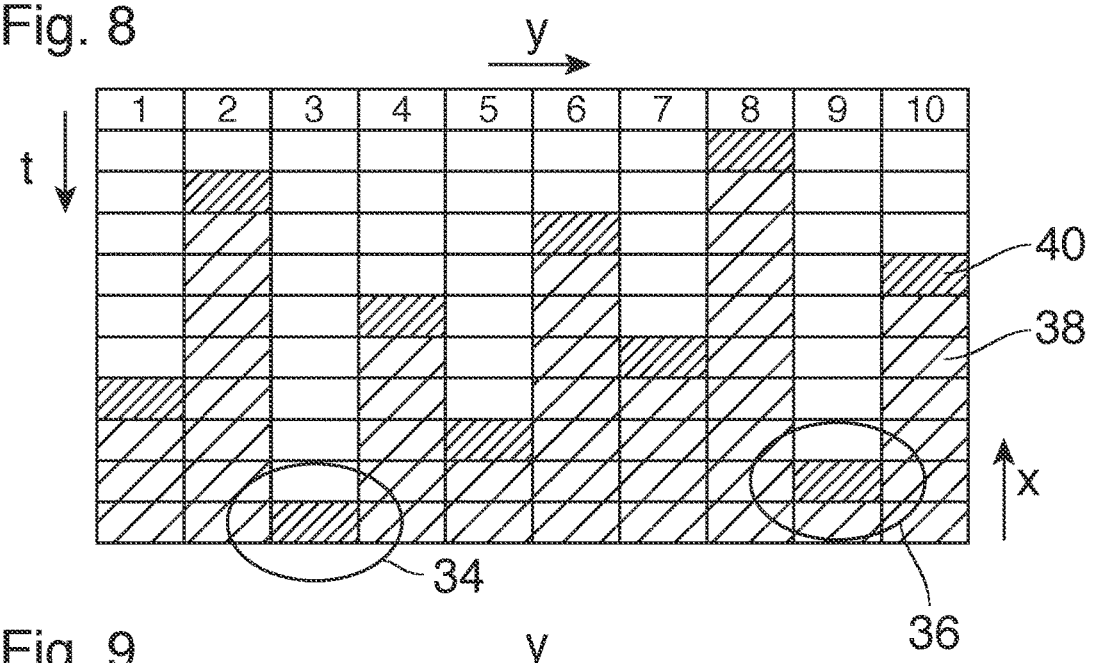
FIG. 8 is a schematic representation of a pattern that corresponds to the staggered arrangement of nozzles in the nozzle plate shown in FIG. 2.

FIG. 8 is a y-t-diagram illustrating the history of ink dots printed in the same pixel line in the y-positions 1-10. The time t is indicated on the vertical axis in units that correspond to the spacing between the rows 24 (FIG. 2) divided by the scanning speed. Since, as is shown in FIG. 3, the nozzle at y-position 8 is located in the first of the rows 24, the ink dot at y=8 is the first to be printed and has the smallest time coordinate t in FIG. 8. Correspondingly, the ink dot at y=3 is the last to be printed. At the time when this ink dot, highlighted by an ellipse 34 in FIG. 8, is printed, the ink dot at y-position 8 has already existed for ten time units during which the ink had the possibility to coalesce.

The ink dot at y=3 fills a gap between neighboring ink dots at y-positions 2 and 4 which, at the time of printing in position 3, have an age of 9 and 6 time units, respectively, so that these ink dots may have shrunk and shifted considerably, similarly as in FIG. 4. Consequently, this pixel position y=3 is particularly apt to artefacts. A similarly critical y-position is y=9, highlighted by an ellipse 36, where the age of the neighboring ink dots, at positions 8 and 10, is 9 time units and 6 time units, respectively. For all the other y-positions, the difference in the age of the ink dots is significantly smaller, so that the risk of artefacts of the type shown in FIGS. 4, 6 and 7 is smaller. This is why, in the method proposed here, the region where the primer 18 is applied is confined to the neighborhood of the critical y-positions 3 and 9. This is also the reason why the primer print head 14 has no nozzles in positions 1 and 5-7, as shown in FIG. 2. Of course, in general, the print head 14 does have nozzles on these missing positions, but they are not used as often as the critical positions.

The y-t-diagram shown in FIG. 8 can be translated into a y-x-diagram by assuming that all ten nozzles keep firing at maximum rate in order to print a solid black area, and then the nozzles stop firing at a certain point in time. By then, every nozzle will have printed a trace 38 of ink dots extending in x-direction (upwards in FIG. 8) and ending at a point 40 which is the x-position of the nozzle at the time the print process has stopped.

Figure 9:
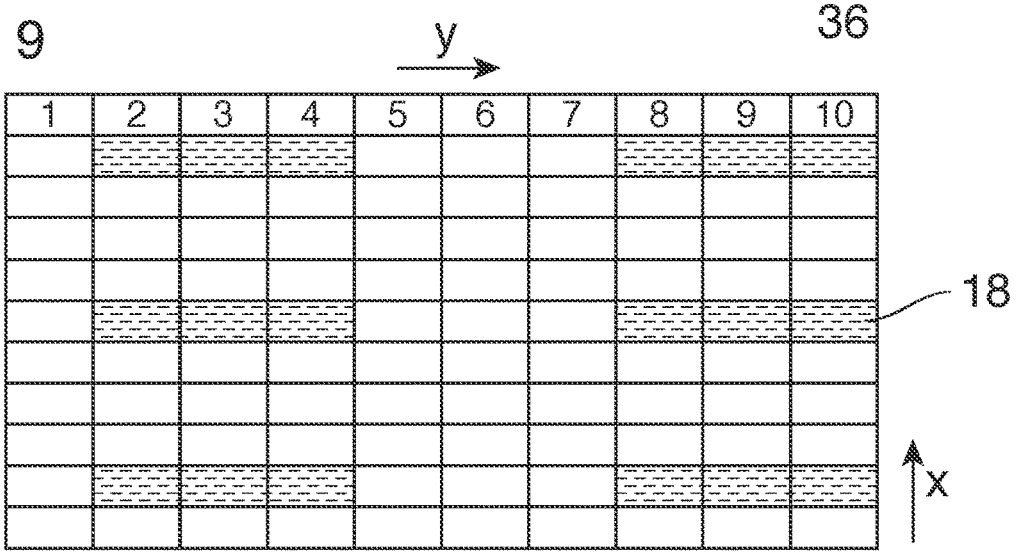
FIGS. 9 and 10 are examples of patterns for printing primer onto the media sheet.

FIG. 9 shows a corresponding y-x-diagram for a pattern in which the primer 18 is printed. The pixel positions where primer 18 has been applied are indicated by shading. It can be seen that the primer 18 is applied only in pixel columns y=2, y=3, y=4 (neighborhood of position 3) and the columns y=8, y=9, y=10 (neighborhood of position 9).

In the example shown in FIG. 9, the nozzles of the primer print head 14 are fired not at maximum rate but only every fourth time unit, so that primer is applied only in every fourth pixel line. This is sufficient to pin the ink traces 38 shown in FIG. 8 (interpreted as a y-x-diagram) and thereby to limit the coalescence and to prevent the gaps at y-positions 3 and 9 from becoming too large, so that no artefacts will be produced at these critical positions.

On the other hand, since the primer 18 is confined to these critical regions, coalescence of the ink in the remaining parts of the printed image will be larger, so that the streakiness of the image can be reduced.

Depending upon the compositions of the inks and primers being used, the presence of the primer layer may lead to a local change in the gloss and/or color gamut of the printed image. In that case, the regular primer pattern shown in FIG. 9 could lead to artefacts in terms of gloss or color. It is possible, however, to mitigate such artefacts by subjecting the pattern in which the primer 18 is applied to an error diffusion process or dithering process, so that the boundaries of the stripes in which the primer 18 is applied become blurred, as has been exemplified in FIG. 10.

Figure 10:
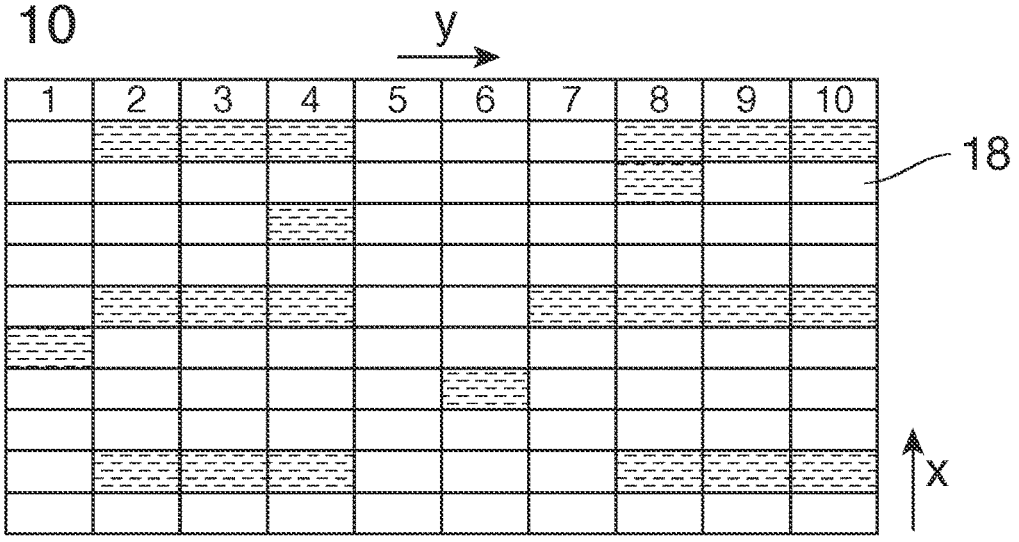
Figure 11:
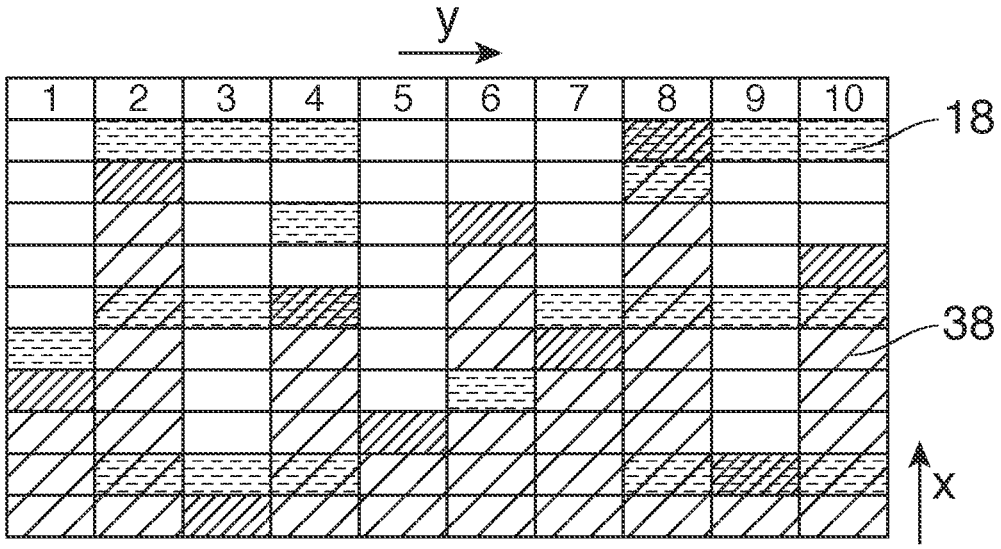
FIG. 11 is a schematic representation showing the pattern of printed ink dots superposed on the primer.

FIG. 11 shows a y-x-diagram similar to the one shown in FIG. 10, but with the traces 38 of ink superposed on the pattern of the primer 18.

It should be understood, that there is no intention to limit the invention to the specific forms disclosed, but on the contrary, the invention is to cover all modifications, alternate constructions and equivalents falling within the scope of the invention as expressed in the appended claims.

What is claimed is:

1. A method of ink jet printing comprising a step of printing a primer onto a media sheet and a step of printing with ink onto the media sheet so as to form an image superposed on the primer, the step of printing with ink being carried out with a print head having an array of nozzles staggered in several rows, while performing a relative scan movement of the print head and the media sheet in a transport direction normal to the rows, wherein the primer is printed on the media sheet non-uniformly in a pattern that corresponds with a pattern in which the nozzles of the print head are staggered.

2. The method according to claim 1, wherein the primer is concentrated near a pixel column for which an offset, in the transport direction, between neighboring nozzles is larger than a predetermined value.

3. The method according to claim 2, wherein the primer is printed on the pixel column in which the offset of the corresponding print head nozzle from the neighboring nozzle is larger than said predetermined value.

4. The method according to claim 1, wherein the pattern of the primer comprises pixel lines which extend in parallel with the rows and are separated from one another by pixel lines that are not filled with primer.

5. The method according to claim 1, wherein the pattern of the primer is subjected to a filter process that blurs the edges of the regions where the primer is present.

6. A software product comprising program code on a computer-readable non-transitory medium, which program code, when run on a controller of an ink jet printer configured for printing with primer and ink, causes the printer to perform a method according to claim 1.

* * * * *